US009856733B2

(12) United States Patent
Olsson et al.

(10) Patent No.: US 9,856,733 B2
(45) Date of Patent: Jan. 2, 2018

(54) METHOD AND ROCK BOLTING RIG FOR INSTALLATION OF A ROCK BOLT

(71) Applicant: Atlas Copco Rock Drills AB, Orebro (SE)

(72) Inventors: Jan Olsson, Orebro (SE); Rene Deutsch, Orebro (SE)

(73) Assignee: Atlas Copco Rock Drills AB, Orebro (SE)

( * ) Notice: Subject to any disclaimer, the term of this patent is extended or adjusted under 35 U.S.C. 154(b) by 44 days.

(21) Appl. No.: 14/405,708

(22) PCT Filed: Jun. 27, 2013

(86) PCT No.: PCT/SE2013/050804

§ 371 (c)(1),
(2) Date: Dec. 4, 2014

(87) PCT Pub. No.: WO2014/011100

PCT Pub. Date: Jan. 16, 2014

(65) Prior Publication Data

US 2015/0117961 A1 Apr. 30, 2015

(30) Foreign Application Priority Data

Jul. 9, 2012 (SE) ..... 1250804

(51) Int. Cl.
*E21D 20/00* (2006.01)
*E21B 19/20* (2006.01)
(Continued)

(52) U.S. Cl.
CPC ..... *E21D 20/003* (2013.01); *E21B 7/02* (2013.01); *E21B 19/20* (2013.01); *E21D 20/006* (2013.01); *E21D 21/00* (2013.01); *E21D 21/004* (2013.01)

(58) Field of Classification Search
CPC ..... E21D 20/003; E21D 20/006; E21D 21/00
See application file for complete search history.

(56) References Cited

U.S. PATENT DOCUMENTS 4,105,081 A 8/1978 Parraud
4,158,520 A * 6/1979 Prebensen ..... E21B 7/025 173/147
(Continued)

FOREIGN PATENT DOCUMENTS

CA 2323845 a1 * 4/2001
DE 102008024365 11/2009
(Continued)

OTHER PUBLICATIONS

Machine Translation of EP 0020271, 4 pages, May 16, 2016.*

*Primary Examiner* — Sunil Singh
(74) *Attorney, Agent, or Firm* — Mark P. Stone

(57) ABSTRACT

The present invention relates to a method for installation of a rock bolt (124) in a first drill hole by means of a rock bolting rig (100), wherein said rock bolting rig (100) comprises a carrier (101), a boom unit (102) fastened to said carrier (101), and a bolt unit (103) fastened to said boom unit (102) via first joint means (106), wherein said bolt unit (103) comprises a feeder unit (104) including means for displaceable carrying of a drilling machine (105), wherein said bolt unit comprises a first (103A) end and holding means (123, 125) for holding said rock bolt (124). The method comprises: —by means of said first joint means (106) maneuver said first end (103A) of said bolt unit (103) to a first position for loading of a bolt, —when said bolt unit (103) has been maneuvered to said first position for loading of a bolt, providing a rock bolt (124) to said bolt unit (103), for being held by means of said holding means (123, 125), and —when said bolt unit (103) has been loaded with said rock bolt (124), maneuver said bolt unit (103) to a position for
(Continued)

installation of said rock bolt (124) and loaded with said rock bolt (124) drilling said first hole and installing said rock bolt (124) in said first hole. The invention also relates to a rock bolting rig.

32 Claims, 4 Drawing Sheets

(51) Int. Cl.
*E21B 7/02* (2006.01)
*E21D 21/00* (2006.01)

(56) References Cited

U.S. PATENT DOCUMENTS 4,226,559 A 10/1980 Prebensen
4,229,124 A 10/1980 Frey et al.
4,395,850 A 8/1983 Talvansaari
4,398,850 A * 8/1983 Talvensaari ..... E21D 20/006 173/193
4,497,378 A 2/1985 Beney et al.
4,832,536 A 5/1989 Spross et al.
5,016,942 A 5/1991 Spross et al.
5,114,279 A 5/1992 Bjerngren et al.
6,698,529 B2 3/2004 Coombs et al.
7,032,686 B2 4/2006 Barthomeuf et al.
7,428,936 B2 9/2008 Hinshaw et al.
7,438,141 B2 10/2008 Hinshaw et al.
7,704,018 B2 4/2010 Hinshaw et al.

FOREIGN PATENT DOCUMENTS

EP 0020271 a * 12/1980
EP 0034134 8/1981
EP 0130969 1/1985
GB 984880 3/1965

* cited by examiner

METHOD AND ROCK BOLTING RIG FOR INSTALLATION OF A ROCK BOLT

FIELD OF THE INVENTION

The present invention relates to methods for installation of rock bolts and in particular to a method for installation of a rock bolt. The invention also relates to a rock bolting rig.

BACKGROUND OF THE INVENTION

It is common that mining for extraction of ore bodies is carried out in drifts that are relatively low and narrow. For example, when extracting ore it is for economical reasons often desirable that the extraction of ore is carried out in such a manner that preferably only the ore body is extracted, thereby reducing the amount of surplus rock that must be taken care of to the largest possible extent, i.e. as little as possible of surrounding rock/ore should be brought with the extracted ore for further treatment.

Ore bodies can be disposed in relatively thin layers (order of magnitude of 1-2 meters thick), which has as result that extraction of thin ore bodies and/or where only a thin portion of the ore body comprises a desired content of ore, extraction can be carried out with drifts of very low heights as result, with consequent demands on the rock drilling rig to allow extraction of ore with a limited height.

During extraction of ore of the above kind, but also in other situations where rock drilling is carried out in narrow/low drifts, as well as during rock drilling in general, it is often desirable, and oftentimes a requirement, that walls and roof in an already drilled portion of a drift are reinforced to ensure that rock/stone portions can not come loose and fall down with the risk for injuries on man and machine as result.

This reinforcement is often performed by installation of rock bolts, in general according to some predetermined pattern, such as e.g. with a certain largest mutual distance between the bolts, where the rock bolts after installation secures the rock. Installation of rock bolts of this kind, which installation usually consists of drilling of a hole with subsequent installation of the rock bolt in said hole, is often carried out by means of machines.

This rock reinforcement, however, usually requires a certain smallest bolt length which, when the drifts are low/narrow, has the result that the length of the bolt in addition to the dead length of the bolt unit, i.e. the length behind the rock bolt that is required for a bolt installation to be able to take place, exceeds the height/width of the drift, with the result that manual actions taken by the operator often are required.

For example, presently occurring bolt units, even though these often are designed especially for use in narrow drifts, can require that the operator in a plurality of stages in the operation during the bolt installation operation actively must perform a plurality of stages of the operation at the position for bolt installation, and thereby at a position under unsecured rock. Examples of such manual actions to be taken consist of joining/changing drill rod, and also manual insertion of the rock bolt in the drilled hole at least to some extent before the space behind the rock bolt is sufficient to enable the remaining part of the rock bolt to be inserted in the drilled hole with the aid of the machine.

Consequently, there are a plurality of stages in the operation where the operator can be forced to work under unsecured rock, and also stages in the operation where drill rod and/or rock bolt are worked in the partly or completely drilled hole, with the risk for portions surrounding the drill hole loosening and falling down with the risk for injuries as result.

SUMMARY OF THE INVENTION

It is an object of the present invention to provide a method for installation of a rock bolt in a first drill hole that can reduce risks involved in stages in the operation where an operator of a rock drilling rig is forced to work under unsecured rock. This object is achieved by the present invention.

The present invention relates to a method for installation of a rock bolt in a first drill hole by means of a rock bolting rig, wherein said rock bolting rig comprises a carrier, a boom unit fastened to said carrier, and a bolt unit fastened to said boom unit via first joint means, wherein said bolt unit comprises a feeder unit having means for displaceable carrying of a drilling machine, wherein said bolt unit comprises a first end and holding means for holding said rock bolt, wherein the method comprises:

- by means of said first joint means, maneuvering said first end of said bolt unit to a first position for loading of a bolt,
- when said bolt unit has been maneuvered to said first position for loading of a bolt, providing a rock bolt to said bolt unit, to be held by said holding means, and
- when said bolt unit has been loaded with said rock bolt, maneuver said bolt unit to a position for installation of said rock bolt and loaded with said rock bolt drilling said first hole and installing said rock bolt in said first hole.

According to the present invention, it is provided a bolt installation method with a rock bolting rig, and in particular a bolt unit adapted for this, which makes possible mechanized drilling and bolt installation in such a manner that all work that is performed by the operator can be carried out from a secure location, where the operator during the bolt installation method consequently is not forced to presence at a location under unsecured rock e.g. to exchange drill rod when drilling a hole for bolt installation, or for insertion of a rock bolt in the drilled hole. The invention, consequently, considerably reduces the risk for injuries.

This is achieved in particular by bringing the bolt unit to a position for loading before the hole is drilled, wherein, at said position for loading, a rock bolt can be provided to the bolt unit by an operator without the operator being exposed to unsecured rock. The bolt unit comprises holding means for holding the rock bolt that has been provided by the operator. The bolt unit can then be maneuvered to a desired position for bolt installation, and be fixated in this position, whereby drilling and bolt installation can be performed without the need for the operator to walk to the bolt unit.

Consequently, the present invention provides a device that makes it possible for a bolting method to be performed completely without subjecting an operator to being present under unsecured rock, where the mechanized method also facilitates operation for the operator. Still, the rock bolt, by being held parallel to the feeder, can be of a length that is as long as possible and, in principle, have a length that corresponds to the height of the drift or the length of the bolt unit.

Further characteristics of the present invention and advantages thereof will be apparent from the following detailed description of exemplary embodiments and the attached drawings.

DETAILED DESCRIPTION OF EXEMPLARY EMBODIMENTS

Figure 1:
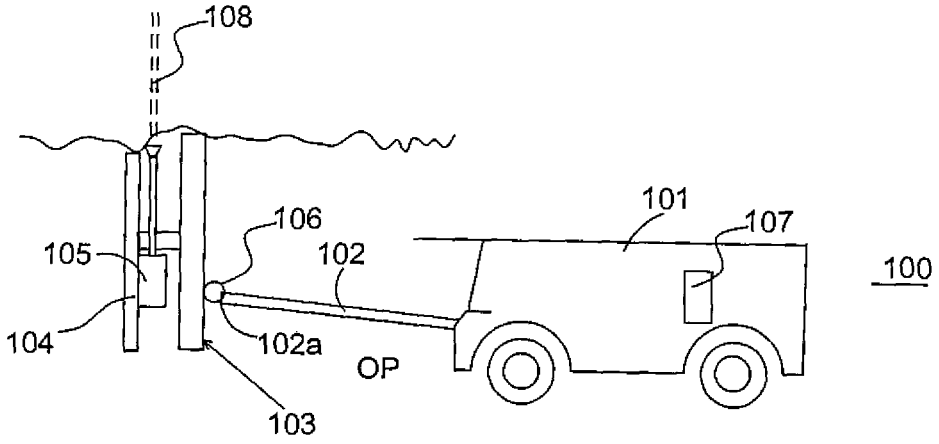
FIG. 1 shows a rock bolting rig having a bolt unit according to the present invention, intended for use in bolt installation in particular in drifts of low heights.

In FIG. 1 is schematically shown a rock bolting rig 100 according to the present invention in position for drilling of a hole 108 for installation of a rock bolt. The rock bolting rig 100 comprises a boom 102, one end of which being fastened to a (schematically indicated) carrier 101, which e.g. can be constituted by a vehicle, and where a bolt unit 103 is pivotally fastened to the second end 102*a* via a first joint means 106. The bolt unit comprises a feeder unit 104 which carries a drilling machine 105. The drilling machine 105 is displaceable along the feeder unit 104 by means of a slide 122 running along the feeder 104. The rock bolting rig 100 further comprises a control system including at least one control unit 107 for control of various functions occurring at the rock bolting rig 100.

In the disclosed embodiment, the boom 102 consists of a single elongated portion, but it can also take any other shape, such as e.g. be arranged to comprise two boom portions, which are joint by means of joint means to thereby provide further degrees of freedom when maneuvering the bolt unit 103.

Drilling in rock in conditions with low drift heights make higher demands on the design of the rock drilling rig, and the rock bolting rig 100 shown in FIG. 1 is particularly suitable for use in drilling and/or bolting when working in low and/or narrow drifts, such as e.g. in drifts having a height and/or width in the order of 1.6-2 meter, where bolting using bolt lengths essentially corresponding to the height of the drift must be used in order to reduce the risk for collapsing rock/stones to a desired extent.

The function of the rock bolting rig 100, such as movement/maneuvering of the carrier 101 and the bolt unit 103 and also the bolt installation operation, is controlled according to the present example by an operator being present at the rock bolting rig 100, which controls the rock drilling rig 100 from an operator position. Since rigs of the disclosed kind by nature are relatively small as the heights of the drifts according to the above can be low, the operator position can be so arranged that the operator is standing next to the machine, and consequently is not onboard the carrier, although such a solution is also possible.

Figure 4:
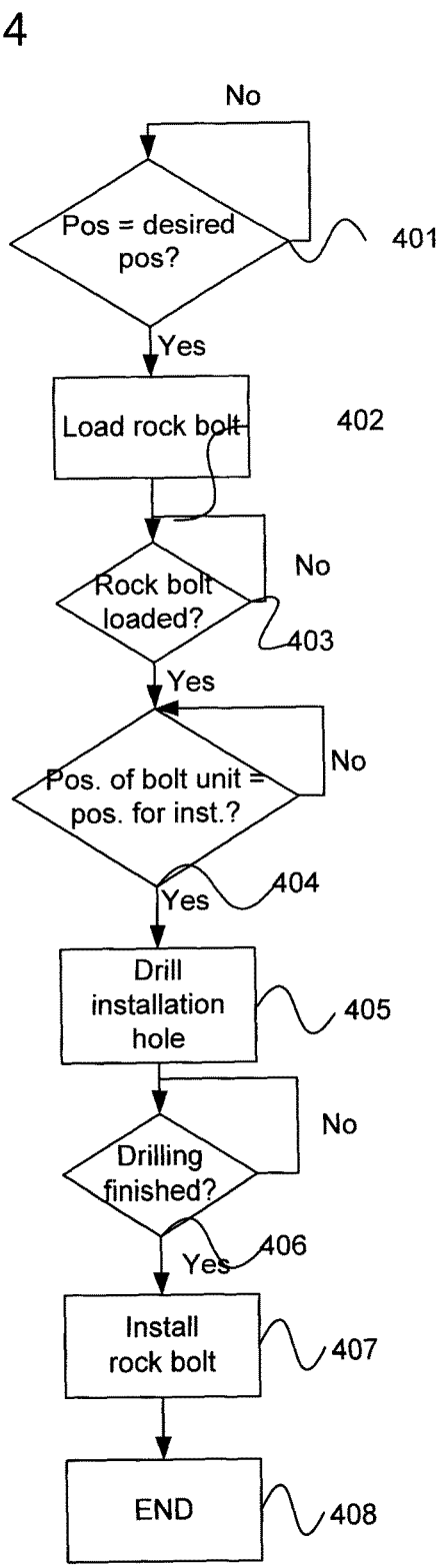
FIG. 4 shows an exemplary method according to the present invention.

The present invention will now be described in connection to an exemplary method 400 for bolt installation according to the present invention, which is shown in FIG. 4. The method is started when the position of the rock bolting rig 100 (in particular the position of the carrier 101) is a desired position for bolt installation. This can be determined e.g. by the control system 107 of the rock bolting rig 100, where a predetermined bolt installation plan can be stored. Alternatively this can e.g. be determined by the operator of the drilling machine which e.g. can maneuver the rock bolting rig 100 to a desired position for bolt installation.

In step 401 it is determined whether the position of the rock bolting rig 100 (the position of the carrier) is the desired position, whereby bolt installation can commence, which e.g. can be initiated automatically by the control system or by the operator by maneuvering of suitable maneuvering means at said operator position, in which case the method continues to step 402.

Oftentimes, a plurality of rock bolts are installed from a same carrier position, for which reason the boom 102 advantageously is pivotally fastened to the carrier 101 to allow a larger degree of freedom when maneuvering the bolt unit 103. By means of the boom 102, the bolt unit 103 can be maneuvered to a desired position for bolt installation, and consequently without any movement of the drilling rig being required, by means of suitable maneuvering of bolt unit and/or boom to position the bolt unit in the desired position for bolt installation. When the one or more bolt installations of a particular carrier position have been carried out, the carrier can be advanced for installation of a further set of rock bolts. For example, the distance that the carrier is advanced in the longitudinal direction of the carrier between installation of two sets of rock bolts can be 1 meter. Consequently, the rock bolting rig is advanced as the bolt installation method progress, and even if the bolt installation method in general progress in a direction of excavation, and thereby in the direction towards unsecured rock, the movement will still have the result that at least a part of the rock bolting rig after being moved will be located under rock that has already been secured by bolt installation at a preceding rock bolting rig position.

When the rock bolting rig 100 has been moved to a position for bolt installation, a loading of a rock bolt for subsequent installation at the desired position is performed in step 402. According to the present invention, this loading of the bolt is performed prior to the drilling of the hole in which the rock bolt is to be installed.

The loading of the bolt is achieved by rotating, by means of said first joint means 106, the bolt unit 103 towards the carrier 101, in particular one end of the bolt unit 103, and in the present example its front end, i.e. the end 103A that during drilling is directed towards the drill hole. Rotation of the bolt unit 103 by means of the joint means 106, the movement of which being controlled according to the present example by means of a hydraulic cylinder 120, in the direction of the carrier 101 maneuvers the bolt unit 103 in the direction of already secured rock at the same time, since the bolting operation follows rock excavation and consequently is performed successively in the direction of excavation as the mining/ore extraction progress. The bolt unit 103 is thereby moved to a position for loading, whereby it can also be ensured that the bolt unit 103 at least partially is moved to a position under already secured rock, or at least becomes reachable for an operator to perform loading of a rock bolt from an operator position under secured rock. This position is indicated by "OP" in FIG. 1. According to the present example, it is sufficient that one end of the bolt unit 103, in this case the front end 103A of the bolt unit 103 according to the above, is moved to a position that is reachable from a position from under secured rock by means of a rock bolt.

According to the above, the drilling machine 105 is arranged to be displaceable along the feeder 104 by means of the slide 122, and, according to the present embodiment, a first, rear, bolt holder 123 is fastened to the slide 122, and which consequently is arranged to be displaced along the feeder when the slide 122 is displaced. At the same time as, or after, the bolt unit has been maneuvered to the position for loading, the slide 122 of the drilling machine, and thereby the rear bolt holder 123, is moved forwards along the feeder unit 104, i.e. in the direction of the front end 103A of the bolt unit, which in the position for loading is directed towards secured rock, in order to facilitate the bolt loading operation.

The bolt 124 is then loaded by the operator by the rock bolt being positioned in the rear bolt holder 123, which in the position for loading consequently can be fed forward towards the operator. In this way, the operator can put one end (the rear end) of the rock bolt in the rear bolt holder, and, due to the length of the rock bolt, this can be performed from under secured rock even in situations where the bolt unit itself has not by certainty been moved to a position under reinforced rock.

The front portion of the bolt is then guided into a second, front, bolt holder 125, where the front bolt holder 125, e.g. can be provided with jaw means arranged to be opened at the maneuvering to the position for loading, and where the front bolt holder can be so arranged that, at the position for loading, the rock bolt is allowed e.g. to be "put" in position in the front bolt holder by the operator. The jaw means can then be at least partially closed to prevent the rock bolt 124 from being moved out of position at a subsequent movement of the bolt unit 103. Consequently, the operator can guide the rock bolt into the rear bolt holder in a simple manner to thereafter put the rock bolt in position in the front bolt holder, while at the same time the operator all the time is present under secured rock.

Instead of the front bolt holder 125 comprising jaw means, the front bolt holder 125 can, instead, e.g. be designed as a through hole through which the rock bolt can be guided. According to one embodiment, the rock bolt 124 is consequently first guided through the front bolt holder 125 to then be put in position in the rear bolt holder 123, which, in a corresponding manner, can be of a different kind. Both the front 125 and the rear 123 bolt holder, respectively, can be arranged to selectively be able to grip the rock bolt firmly and also in a manner allowing the rock bolt to be displaced, according to the below. This kind of holding means are well known to the person skilled in the art, and can e.g. be achieved by means of cylinder shaped holding means where radially operative means can be controlled to selectively accomplish firm gripping of the rock bolt, alternatively jaw means can be closed to different extent.

When the rock bolt 124 has been put in position by the operator, this can be indicated to the control system 107 of the drill rig, e.g. by maneuvering of suitable maneuvering means such as maneuvering of a stick or an input via e.g. a keyboard or a touch sensitive display. The front bolt holder 125, when suitable, is then closed to a position where the rock bolt is kept in position but is allowed to be displaced, while the rear bolt holder 123, by means of maneuvering of suitable means according to the above, can be controlled to firmly grip the rock bolt, so that the rock bolt, by backing the slide 122 along the feeder unit can be brought backwards and thereby be "pulled in" into the bolt unit when the slide 122 is moved backwards along the feeder unit.

Figure 3:
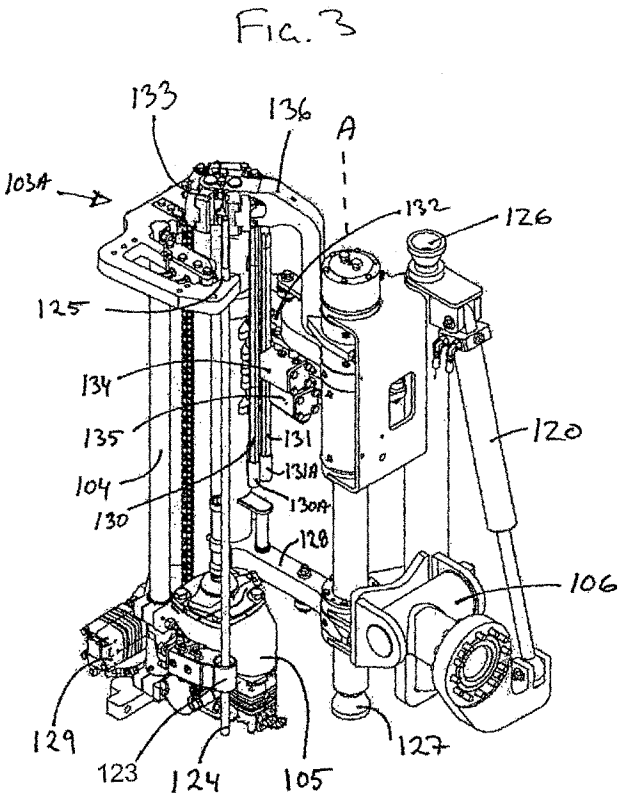
FIG. 3 shows an exemplary embodiment of a bolt unit according to the principle drawing shown in FIG. 2.
Figure 2:
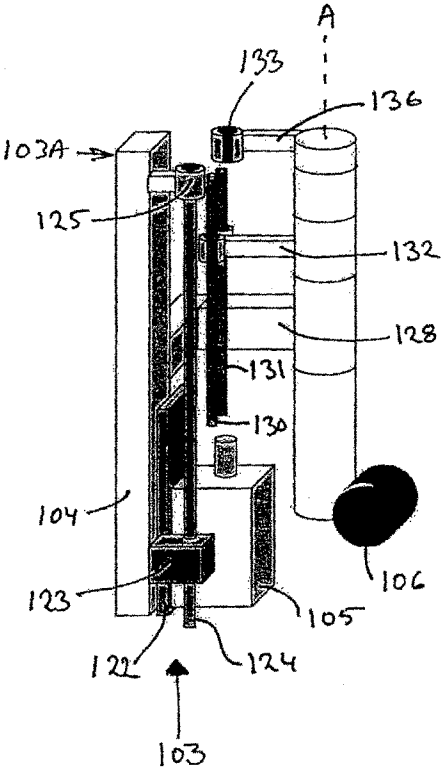
FIG. 2 shows a principle drawing of a bolt unit according to one embodiment of the present invention.

When this has been performed, the rock bolt 124 is in the position shown in FIG. 2-3, wherein the rock bolt consequently is arranged parallel to the slide/the drilling machine 105, and also parallel to the drilling axis along which drilling is carried out, and where the rock bolt consequently can have a length essentially corresponding to the length of the bolt unit, and in particular a length that exceeds the distance that the slide can be displaced along the feed beam. When the slide has been backed to a position where the rock bolt reaches the desired position, the front bolt holder 125 can be arranged to firmly grip the rock bolt 124 while at the same time the firm grip of the rock bolt 124 is released by the rear bolt holder 123 to allow displacement of the slide 122 relative to the rock bolt 124 during drilling. This can be arranged to be performed by the operator or the control system.

When it is determined that the rock bolt 124 is in the installation position, step 403, the bolt unit 103 is maneuvered, by the operator or by the control system, to the desired position for bolt installation. Many times the roof and walls of the drift are marked with markings where rock bolts are to be installed. The operator can then maneuver the bolt unit 103 in position for installation of a rock bolt 124 at the respective marking.

When it is determined that the bolt unit 103 has been brought to the desired position for bolt installation, step 404, the bolt unit is fixated in a conventional suitable manner, according to the present example by means of front 126 and 127 support legs, respectively. After the bolt unit 103 has been fixated by means of the support legs 126, 127, the bolt unit 103 is, according to the present invention, kept continuously fixated during the bolt installation operation, that is, the drilling of the bolt installation hole and subsequent bolt installation is performed without movement of the bolt unit 103, and thereby without requirement for associated release of the support legs 126, 127.

According to the present example, all the functionality of the bolt unit 103 is suspended about an axis A, which in the present example coincides with the axis of the rear support leg 127, but this, of course, must not be the case. According to a preferred embodiment, the rotation of the feeder 104 about the axis A is such that a rotation can occur between a first position, preferably and in the present example constituting a first end position, and a second position, preferably and in the present example constituting a second end position. According to the present example, a first of said end positions consists of a position where the feeder 104 is in a position where the center of the drilling machine, i.e. the center of the drilling, is in the center of the hole, while in the second end position the center of the bolt of the rock bolt 124 is in the center of the hole instead. The bolt holders 123, 125 are consequently so arranged at the bolt unit that rotation of the feeder has as result that the rock bolt moves along a periphery of a circular arc having the center in the axis A that passes through the center of the drilling. Rotation of the feeder between the first and second end position, respectively, is achieved by means of a feeder arm 128.

Consequently, when the bolt unit 103 has been positioned and fixated for bolt installation with the feeder in said first end position, drilling of the hole 108 for bolt installation is performed in step 405, where the drilling commence with a first 130 of two drill rods 130, 131 being brought towards the center of the drilling. Said first drill rod 130, as well as a second drill rod 131, are carried by gripping means 134, 135, respectively, being arranged on a rotatable drill rod arm 132, where the drill rod arm 132 also rotates about the axis A. The drill rods 130, 131 are arranged on said drill rod arm 132 in such a manner that they, when rotating the drill rod arm 132 about the axis A, are moved along a circular arc having the center in the axis A and which passes through the center of the drilling (the center of the hole). Consequently, an arbitrary of the two drill rods 130, 131 can be positioned in the center of the drilling by suitable rotation of the drill rod arm 132 to different positions along said circular arc.

The drill rods 130, 131 are further arranged, by means of said drill rod arm, to be held in axial direction in such a manner that the drill rods 130, 131, when being maneuvered to the center of the drilling, freely can be introduced in front of the drilling machine 105 when this has been backed to a rear position on the feeder 104. The drill rods are further arranged to be freely be movable relative to an upper drill rod support in the form of a jaw means 133. This can e.g. be ensured when the drill rod arm again grips the drill rod after finished drilling by, according to the below, performing this gripping when the drilling machine, and the drill rod which then is threaded together with the drilling machine, has been backed to a suitable position after drilling.

Consequently, when said first drill rod 130 has been brought to the center of the drilling, the slide 122, and thereby the drilling machine 105, is maneuvered in the direction towards said drill rod while at the same time the drilling machine 105 is set to a rotation, so that, when the threads of the drilling machine reaches said first drill rod, the drill rod 130, being held by the drill rod arm 132, is threaded together with the drilling machine 105 while at the same time the drilling machine is moved forward towards the drill rod, preferably at a speed that is adapted to the pitch of the thread and the rotation speed of the drilling machine 105.

When the drilling machine 105 has been threaded together with said drill rod 130, the grip of the drill rod 130 by the gripping means 134 is released, so that the drill rod arm 132 can be brought to the side to the position of rest. Drilling by means of the first drill rod 130 is then carried out in a suitable manner, such as e.g. by using conventional initial drilling, and e.g. controlled by the control system of the drilling rig. During at least the initial drilling the jaw means of the drill rod support 133 can be closed to thereby guide but not grip the drill rod. The jaw means can then be opened after finished initial drilling. The drilling process then continues until the rear end of the first drill rod 130 has reached the upper drill rod support, which can be determined by means of suitable sensor, alternatively by means of the operator controlling forward feeding of the drilling machine, and thereby also when drilling is to be stopped.

The drill rod 130 comprises a sleeve 130A in the end towards the drilling machine 105, which houses said threads for being threaded together with the drilling machine 105 and the second drill rod 131, respectively, according to the below, and which sleeve 130A has a larger diameter compared to the remaining portion of the drill rod. When the drilling has progressed to such extent that the sleeve 130A reaches the jaw means of the drill rod support 133, the jaw means are again closed, where the larger diameter of the sleeve 130A has as result that the jaw means, instead of only guiding the drill rod, grips the drill rod for firm holding of this instead. Consequently, the drill rod support is so arranged that in a closed position, the sleeve 130A of the drill rod is firmly gripped, but which in the same closed position only guides the other, narrower, portion of the drill rod to, e.g. during initial drilling, guide the drill rod when this is displaced through the drill rod support by means of the drilling machine. The drill rod support can be arranged to, via a drill rod support arm 136, be brought to the side after finished initial drilling until the sleeve 130A of the drill rod 130 is to be gripped.

Consequently, when the sleeve of the drill rod 130 is gripped by the drill rod support, the drilling machine 105 can be loosened and be backed along the feeder 104. In this situation the second drill rod 131 is rotated by means of the drill rod arm 132 into the drilling center. In a manner similar to the first drill rod 130, the drilling machine 105 can be threaded together with the second drill rod 131, after which the drill rod arm 132 releases the grip of the drill rod 131 and is brought to the side, and after which the drilling machine 105 with the second drill rod 131 is moved towards the first drill rod 130 to be threaded together with this, where this joining consequently is made possible by the holding of the first drill rod by drill rod support 133.

After threading together the two drill rods, the grip of the drill rod 130 by the drill rod support is released, so that the drill rod support 133 can be moved to the side. Drilling then progress until drilling of the hole to a hole having a hole depth essentially corresponding to the total length of the first drill rod and the second drill rod is finished. Consequently, when the drilling of the hole to a desired depth is finished, the drilling machine 105, and thereby the drill string consisting of the two drill rods, is backed to a position where the sleeve of the front drill rod 130 again can be gripped by the drill rod support 133. The second drill rod 131 can thereby be loosened from the first drill rod 130, and the drilling machine 105 be backed further along the feeder 104, preferably to the position at which the drill rod arm previously was released, whereby the drill rod arm 132 can be moved towards the drill rod 131 and grip the drill rod 131 at an axial position essentially corresponding to the position at which the grip of the drill rod arm previously was released according to the above. Consequently, it can be ensured that the drill rod 131 is gripped at an axial position along the drilling axis where the drill rod can be moved clear from the drill rod support while at the same time the drilling machine can be loosened from the drill rod and backed to clearance from the drill rod. In this way the drill rod can be moved to a correct position also at a subsequent drilling of another hole.

Consequently, by gripping the drill rod 131 by means of the gripping means 135, the drilling machine 105 can then be loosened from the drill rod 131, so that the drill rod 131 can be moved to the side. The drilling machine 105 can then be fed forward to the front drill rod 130 for being threaded together with this, so that following this threading together the drill support releases the drill rod, whereby the first drill rod can also be backed to a suitable position for being gripped by the gripping means 134 of the drill rod support arm 132 of the first drill rod so that the first drill rod also will be able to be moved to a correct position at a subsequent drilling of another hole.

In FIG. 3 is also shown a preferred feature regarding the slide according to an embodiment of the present invention. In general, the drive unit for powering the displacement of the slide along the feed beam 104 is arranged at the rear end of the feeder unit 104. According to this embodiment, the drive unit 129 for powering the displacement of the slide along the feeder is instead arranged on the slide 122. The drive unit 129 can, for example, consist of a hydraulic motor and a chain wheel, where the chain wheel rotates on a suspended chain that runs along the feeder. When the drive unit 129 is arranged at the rear end of the feeder unit 104 in a conventional manner, this results in a longer dead length, which reduces the length that the slide can be displaced along the feeder unit 104. The present invention has the advantage that the slide 122, and thereby the drilling machine 105, can run along a longer portion of the feeder unit 104, and in particular be moved further towards the rear end of the feeder so as to make available as much space as possible in front of drilling machine for drill rod and/or rock bolt, which is advantageous in particular in drilling/bolt installations in space restricted drifts with space requirements on the machine.

Consequently, when it is determined that drilling of the hole has been completed, step 406, the method continues to step 407 for installation of the rock bolt 124 in the drilled hole. Rock bolts can be of different kinds, and can e.g. be of a kind where, after the rock bolt has been inserted into the drill hole, the rock bolt expands by means of being pressurized. Alternatively, the rock bolt, for example, can be of a kind where a resin is supplied to the drill hole for chemical joining of rock and rock bolt. The present invention is applicable irrespective of the kind of bolt system that is used, but according to the embodiment exemplified in the drawings, a type of rock bolt is used where one or more resin cartridges are first supplied to the drill hole, where the resin consists of a two component resin, and where the rock bolt is then inserted into the drill hole and mixes the two components of the resin by rotation.

Figure 5C:
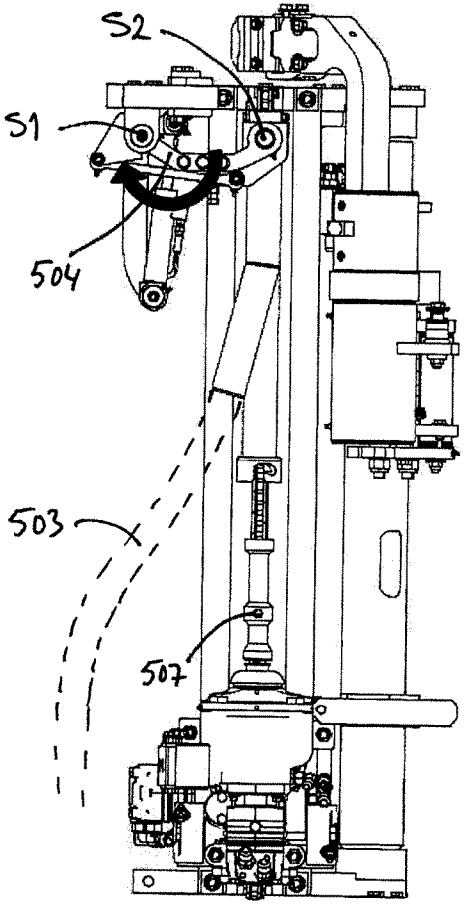
FIG. 5A-C shows further aspects of the bolt unit shown in FIG. 3.
Figure 5B:
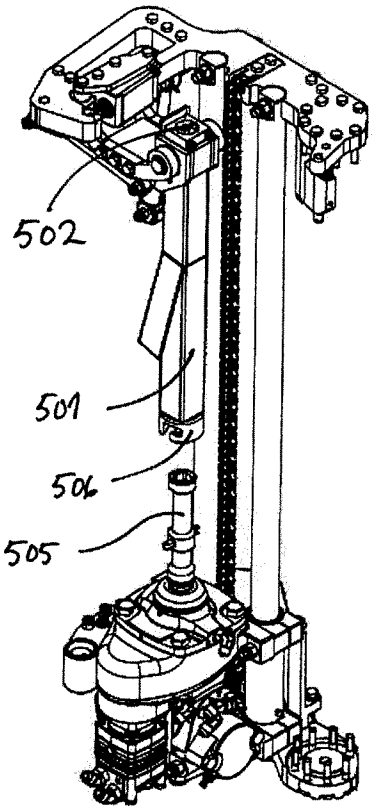
Figure 5A:
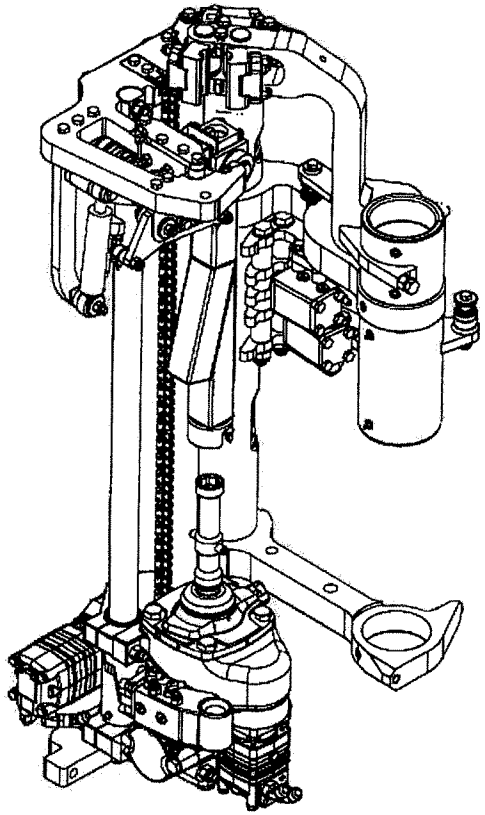

Resin cartridge insertion of this kind oftentimes also require a manual insertion by the operator, and consequently that the operator in this operation also is subjected to undesired risks. According to the present invention, however, resin cartridge insertion is accomplished without the need for the operator to work under unsecured rock. This is achieved by means of an injection arm 501, which is shown in FIG. 5A-C. The injection arm 501 comprises a nozzle 502 which is moved towards the drill hole according to the below, and to which a hose portion 503 (schematically indicated in FIG. 5C) is connected and in the opposite end of which (not shown) one or more resin cartridges can be inserted. According to one embodiment the resin cartridges are loaded in the hose portion 503 when loading the bolt, while according to another embodiment, the resin cartridge/cartridges instead are loaded after drilling of the hole. The hose portion 503 is preferably so arranged that the end facing away from the injection arm 501 is reachable for loading resin cartridges from the protected operator position, either when loading the bolt and/or also when the bolt unit 103 has been fixated for drilling.

The injection arm 501 is arranged to swing about a swing joint S1, via a swing arm 504 where the axis of the swing joint S1 is essentially at right angles to the drilling axis. The injection arm 501 is pivotally fastened to the swing arm 504 in such a manner that when the injection arm is swung towards the drill hole, the injection nozzle 502 is aligned essentially coaxially with the center of the drilling/the center of the hole when swung to this position, see FIG. 5C.

Since the injection arm 501 swings about an axis S1 that is essentially at right angles with respect to the drilling axis, the swing motion not only has the result that the injection nozzle 502 is brought towards the center of the drilling, but also that the injection nozzle 502 is moved from a position of rest shown in FIG. 5A-B in an axial direction towards the drilled hole to reduce the distance between nozzle and hole. Preferably the injection arm is swung to a position where the injection nozzle 502 essentially abuts the drilled hole. When the injection nozzle 502 has been moved towards the drill hole, the one or more resin cartridges can be shot into the drill hole via the injection hose, e.g. by connecting a pressurized fluid such as air to the end facing away from the injection arm 501.

The exemplified injection arm 501 also has a further feature. The shown injection arm is further arranged to carry a bolt adapter 505 for subsequent rotation of the rock bolt. This bolt adapter 505 is, in the present example, supported by a bayonet mount 506 at the end of the injection arms 501 facing away from the drill hole. The bayonet mount 506 is such that the bolt adapter 505 is kept in the bayonet mount 506 coaxially with the nozzle 502, whereby, when the injection arm 501 has been brought to the position for injection, the bolt adapter will also be positioned coaxially with the center of the drilling. The bolt adapter 505 further comprises, at the end facing away from the injection arm 501, a threaded portion (indicated by 507). In this way, when the injection arm is in the position for resin injection, the drilling machine can be fed forward in the direction of the bolt adapter and be threaded together with the bolt adapter. When the drilling machine has then been threaded together with the bolt adapter, a small rotation in the opposite direction can set the bolt adapter free from the injection arms bayonet mount, so that the drilling machine, with bolt adapter, can be backed along the feeder.

This threading together with the bolt adapter 505 can be arranged to be completely controlled by the operator, alternatively be controlled by the control system of the drilling rig. When the drilling machine has been threaded together with the bolt adapter the drilling machine is backed along the feeder, and when the one or more resin cartridges have been loaded in the drill hole, the injection arm is swung back to the position of rest.

According to the above, the bolt 124 has been kept in position parallel to the slide 122 during the whole drilling operation, where the rock bolt 124 has been firmly held by means of the front bolt holder 125 and supported by the rear bolt holder, but where, according to the above, the rear bolt holder 123 during drilling has not gripped the rock bolt 124 since the slide 122 is displaced forwards and backwards along the feeder during the drilling operation.

At the installation of the rock bolt 124 in the drill hole, the feeder is first rotated about the rotation axis A to the second end position, wherein, since the rock bolt 124 according to the above is arranged along a circular arc that passes through the center of the drilling, a rotation of the feeder 104 has the result that the rock bolt 124 is rotated in into the center of drilling. The rear bolt holder 123 is controlled so that the rock bolt 124 is gripped by this, while the grip of the rock bolt 124 by the front bolt holder 125 is released, whereby the rock bolt 124 is inserted into the drilled hole by means of the slide 122 by moving the slide forward along the feeder 104. In this manner, the rock bolt 124 is fed into the hole. The rock bolt 124 is inserted into the drill hole by means of the slide 122 and the rear bolt holder 123 at least to such extent that the rear end of the rock bolt ends up at a location that is advanced enough in the direction of the hole to leave room for the drilling machine and bolt adapter behind the rock bolt when the slide is again backed, but preferably as long as possible given the possible displacement of the slide along the feeder 104.

Consequently, when the rock bolt partly has been inserted into the hole at least to a position where the drilling machine 105 and bolt adapter 505 is given room behind the rock bolt, the feeder is rotated back towards said first end position, i.e. the drilling position, whereby the bolt adapter, which comprises a sleeve for reception of the lower end of the rock bolt, by means of the drilling machine is moved towards the rock bolt, whereby the rock bolt by means of bolt adapter and drilling machine can be inserted all the way into the hole.

By means of the drilling machine, via the bolt adapter, the rock bolt is set to a rotation to achieve a mixing of the two components of the resin when the rock bolt penetrates the one or more resin cartridges. Consequently, when installation of the rock bolt is then finished, the drilling machine is again backed along the feeder, whereby, when the drilling machine has been backed a sufficient distance, the injection arm 501 is again brought to the injection position so that the bolt adapter 505 can be put back to the bolt adapter holder by means of the drilling machine. The bolt installation operation is thereby finished, step 408.

In case the rock bolt is of another kind than a resin bolt, an arm corresponding to the injection arm can still be used to carry a bolt adapter for use in the bolt installation.

When the hole has been drilled, and the rock bolt has been installed, the drill support is released, so that the bolt unit again can be rotated towards an operator position under secured rock for reception of a new rock bolt for installation at another position, which is reached either by only maneuvering the boom/bolt unit, or alternatively by advancing the carrier.

The bolt unit 103 according to the present invention consequently makes possible drilling of a hole with subsequent installation without any action of the operator being required at the bolt unit after the bolt unit 103 has been maneuvered to a drilling position, i.e. without the need for the operator to walk to the bolt unit for taking any actions at the bolt unit during drilling/bolt installation.

Consequently, by means of the present invention, a device is obtained that makes it possible that a bolting operation can be performed completely without exposing an operator to being present under unsecured rock, where the mechanized method also facilitates work for the operator. The present invention further has the advantage that the rock bolt, since this is held parallel to the feeder, and thereby can make use of the full length of the feeder, can be of a length that is as long as possible given the prerequisites, and consequently in principle have a length that corresponds to the height of the drift. This is made possible in particular by, according to one embodiment, the functionality of the bolt unit being suspended about an axis, where the feeder unit is rotatable about this axis, where, in a first position, the feeder unit is in a drilling position with the drilling machine coaxial with the drilling axis, and where, in a second position, the center of the bolt of said rock bolt is coaxial with said drilling axis so that the available length can be used to the most extent without reducing the length of the bolt in order to give room for drilling machine etc. Simple insertion of the bolt is made possible in particular by inserting the bolt in the drilled hole by means of the slide and the bolt holder arranged on the slide without the need for the fixated bolt unit to be released.

The shown steps in the drilling/installation of the rock bolt can be arranged to be initiated in principle completely by the operator of the drilling rig. Alternatively, some of the method steps or the complete bolt installation process can be completely controlled by the control system of the drilling rig. As is realized, the example of a drilling rig according to the present invention shown in the figures merely constitutes an example, and a drilling rig according to the present invention can be of a plurality of different specific embodiments.

A preferred feature of the present invention is that a rock bolt can be provided to the bolt unit without the operator having to leave an area of secured rock, and that the rock bolt is provided to the bolt unit prior to drilling of the hole in which the rock bolt is to be installed, whereby drilling and bolting can be performed with a fixated bolting unit, which makes possible an efficient, time saving and at the same time secure bolt installation.

As is realized, the present invention is not limited to the embodiments of the invention described above, but the invention relates to and comprises all embodiments within the scope of the claims and all equivalents thereto.

The invention claimed is:

1. Method for installation of a rock bolt (124) in a first drill hole by a rock bolting rig (100), wherein said rock bolting rig (100) comprises a carrier (101), a boom unit (102) fastened to said carrier (101), and a bolt unit (103) fastened to said boom unit (102) via a first joint (106), wherein said bolt unit (103) comprises a feeder unit (104) including means for displaceable carrying of a drilling machine (105), wherein said bolt unit comprises a first (103A) end and means (123, 125) for holding said rock bolt (124), wherein the method comprises the steps of:

maneuvering said first end (103A) of said bolt unit (103) by said first joint to a first position for loading of a bolt, wherein said first position for loading of a bolt is a position where said first end of said bolt unit is at a shorter distance from said carrier compared to the distance from said first joint to said carrier, and wherein said first position is a position where said bolt can be provided to said bolt unit from under secured rock, when said bolt unit (103) has been maneuvered to said first position for loading of a bolt, providing a rock bolt (124) to said bolt unit (103) to be held by said means for holding (123, 125), and when said bolt unit (103) has been loaded with said rock bolt (124), maneuvering said bolt unit (103) by said first joint to a position for installation of said rock bolt (124), and loaded with said rock bolt (124) drilling said first drill hole, and installing said rock bolt (124) in said first drill hole;

wherein said means for holding includes a first displaceable holder (123), and wherein during said loading of said rock bolt (124), said means (122) for displaceable carrying of said drilling machine comprises said first displaceable holder (123) for displaceably holding said rock bolt (124), said method comprising the further steps of:

displacing said first displaceable holder (123) in a first direction towards said first end (103A), introducing said rock bolt (124) in said first displaceable holder (123), and gripping said rock bolt (124) by said first displaceable holder, and displacing said first displaceable holder (123) in a direction opposite to said first direction to bring said rock bolt (124) to a loaded position.

2. Method according to claim 1, wherein said means for displaceable carrying of said drilling machine (105) consists of a slide (122), and wherein said first displaceable holder (123) is arranged on said slide (122).

3. Method according to claim 1, wherein said bolt unit (103) further comprises a second holder (125) for holding said rock bolt (124), wherein, when said rock bolt has been brought to said loaded position:

holding said rock bolt (124) by said second holder (125), and changing the grip of said first displaceable holder to allow displacement of said first displaceable holder (123) along said rock bolt (124).

4. Method according to claim 1, further including the step of installing rock bolts at a plurality of carrier positions along a first longitudinal direction, wherein said position for loading of a bolt is such that said rock bolt can be loaded from a location that at a preceding carrier position has been reachable for rock reinforcement.

5. Method according to claim 4, wherein said first longitudinal direction essentially consists of a direction along which excavation of rock is carried out.

6. Method according to claim 1, further including the step of installing a rock bolt where the length of said rock bolt (124) exceeds the length that said drilling machine can be displaced along said feeder unit.

7. Method according to claim 1, further including the step of maneuvering the front end (103A) of said bolt unit (103) to said first position.

8. Method for installation of a rock bolt (124) in a first drill hole by a rock bolting rig (100), wherein said rock bolting rig (100) comprises a carrier (101) a boom unit (102) fastened to said carrier (101), and a bolt unit (103) fastened to said boom unit (102) via a first joint (106), wherein said bolt unit (103) comprises a feeder unit (104) including means for displaceable carrying of a drilling machine (105), wherein said bolt unit comprises a first (103A) end and means (123, 125) for holding said rock bolt (124), wherein the method comprises the steps of:

maneuvering said first end (103A) of said bolt unit (103) by said first joint to a first position for loading of a bolt, wherein said first position for loading of a bolt is a position where said first end of said bolt unit is at a shorter distance from said carrier compared to the distance from said first joint to said carrier, and wherein said first position is a position where said bolt can be provided to said bolt unit from under secured rock, when said bolt unit (103) has been maneuvered to said first position for loading of a bolt, providing a rock bolt (124) to said bolt unit (103) to be held by said means for holding (123, 125), and when said bolt unit (103) has been loaded with said rock bolt (124), maneuvering said bolt unit (103) by said first joint to a position for installation of said rock bolt (124), and loaded with said rock bolt (124) drilling said first drill hole, and installing said rock bolt (124) in said first drill hole;

said method further including the step of drilling along a first drilling axis, wherein said bolt unit (103) comprises a first axis (A) being parallel with the drilling axis, wherein said feeder unit (104) is rotatable about said first axis (A) between a first position and a second position, wherein in said first position the feeder unit is in a drilling position with the drilling machine coaxial with the drilling axis, and wherein in said second position the center of the bolt of said rock bolt is coaxial with said drilling axis.

9. Method according to claim 8, wherein prior to drilling and bolt installation, fixating said bolt unit (103) by at least one support element (127), wherein said axis (A) is essentially coaxial with an axis of said support element.

10. Method according to claim 8, wherein said means for holding includes a first displaceable holder (123), further including the step of arranging said first displaceable holder (123) at said bolt unit so that rotation of the feeder about said first axis (A) moves said rock bolt along a circular arc having the center in said first axis (A) and passing said drilling axis.

11. Method according to claim 10 including the further step of rotating a feeder arm (128) about said axis (A) for rotating the feeder unit between said first and second positions, respectively.

12. Method according to claim 8, wherein said bolt unit further comprises a drill rod arm (132) rotatable about said first axis (A), said method including the step of arranging said drill rod arm (132) to carry at least a first drill rod (130), and when rotating said drill rod arm, moving said first drill rod along a circular arc passing through said drilling axis.

13. Method according to claim 12 further including the step of arranging said drill rod arm (132) to carry at least said first drill rod (130) and a second (131) drill rod, and when rotating said drill rod arm (132), moving said first (130) and second (131) drill rods, respectively, along a circular arc passing through the center of the drilling and having a center in said axis (A).

14. Method for installation of a rock bolt (124) in a first drill hole by a rock bolting rig (100), wherein said rock bolting rig (100) comprises a carrier (101), a boom unit (102) fastened to said carrier (101), and a bolt unit (103) fastened to said boom unit (102) via a first joint (106), wherein said bolt unit (103) comprises a feeder unit (104) including means for displaceable carrying of a drilling machine (105), wherein said bolt unit comprises a first (103A) end and means (123, 125) for holding said rock bolt (124), wherein the method comprises the steps of:

maneuvering said first end (103A) of said bolt unit (103) by said first joint to a first position for loading of a bolt, wherein said first position for loading of a bolt is a position where said first end of said bolt unit is at a shorter distance from said carrier compared to the distance from said first joint to said carrier, and wherein said first position is a position where said bolt can be provided to said bolt unit from under secured rock, when said bolt unit (103) has been maneuvered to said first position for loading of a bolt, providing a rock bolt (124) to said bolt unit (103) to be held by said means for holding (123, 125), and when said bolt unit (103) has been loaded with said rock bolt (124), maneuvering said bolt unit (103) by said first joint to a position for installation of said rock bolt (124), and loaded with said rock bolt (124) drilling said first drill hole, and installing said rock bolt 124) in said first drill hole;

wherein said means for holding includes a first displaceable holder, said method including the further steps of, when said hole for installation of said rock bolt has been drilled, rotating said feeder unit (104) so that the center of the bolt of said rock bolt becomes coaxial with said drilling axis, and partially inserting said rock bolt (124) in said drilled hole by said first displaceable holder by displacing said means for displaceable carrying of said drilling machine (105).

15. Method according to claim 14, said method including the steps of, when said rock bolt has been partially inserted into said drilled hole, rotating said feeder unit (104) back to a position where the feeder unit is in a drilling position with the drilling machine coaxial with the drilling axis, and inserting the remaining part of said rock bolt (124) into said hole by said drilling machine (105).

16. Rock bolting rig for installation of a rock bolt (124) in a first drill hole, wherein said rock bolting rig (100) comprises a carrier (101), a boom unit (102) fastened to said carrier (101), and a bolt unit (103) fastened to said boom unit (102) via a first joint (106), wherein said bolt unit (103) comprises a feeder unit (104) including means for displaceable carrying of a drilling machine (105), wherein said bolt unit comprises a first (103A) end and means (123, 125) for holding said rock bolt (124), wherein the rock bolting rig comprises:

means for maneuvering said first end (103A) of said bolt unit (103) to a first position by said first joint for loading of a bolt, wherein said first position for loading of a bolt is a position where said first end of said bolt unit is at a shorter distance from said carrier compared to the distance from said first joint to said carrier, and wherein said first position is a position where said bolt can be provided to said bolt unit from under secured rock, said means for holding said rock bolt (123, 125) arranged at said bolt unit (103) for, when said bolt unit (103) has been maneuvered to said first position for loading of a bolt, receiving a rock bolt (124), and when said bolt unit (103) has been loaded with said rock bolt (124), means for maneuvering said bolt unit (103) by said first joint to a position for installation of said rock bolt (124) and, loaded with said rock bolt (124), means for drilling said first hole and installing said rock bolt (124) in said first hole;

wherein said means for holding a bolt comprises a first displaceable holder, and wherein said means (122) for displaceable carrying of said drilling machine comprises said first displaceable holder (123) for displaceably holding said rock bolt (124).

17. Rock bolting rig according to claim 16, wherein said means for displaceable carrying of said drilling machine (105) consists of a slide (122), and wherein said first displaceable holder (123) is arranged on said slide (122).

18. Rock bolting rig according to claim 16, wherein said means for holding includes a first displaceable holder (123), and wherein said rock bolting rig comprises, at said loading of said rock bolt (124):

means for displacing said first displaceable holder (123) in a first direction towards said first end (103A), means for introducing said rock bolt (124) into said first displaceable holder (123), and said first displaceable holder (123) including means for gripping said rock bolt (124), and means for bringing said rock bolt (124) to a loaded position by displacement of said first displaceable holder (123) in a direction opposite to said first direction.

19. Rock bolting rig according to claim 16, wherein said bolt unit (103) further comprises a second holder (125) for holding said rock bolt (124), and wherein said rock bolting rig, when said rock bolt has been brought to a loaded position is arranged to:

hold said rock bolt (124) by said second holder, and, when said second holder (125) holds said rock bolt (124), change the grip of said first displaceable holder to allow displacement of said first displaceable holder (123) along said rock bolt (124).

20. Rock bolting rig for installation of a rock bolt (124) in a first drill hole, wherein said rock bolting rig (100) comprises a carrier (101), a boom unit (102) fastened to said carrier (101), and a bolt unit (103) fastened to said boom unit (102) via a first joint (106), wherein said bolt unit (103) comprises a feeder unit (104) including means for displaceable carrying of a drilling machine (105), wherein said bolt unit comprises a first (103A) end and means (123, 125) for holding said rock bolt (124), wherein the rock bolting rig comprises:

means for maneuvering said first end (103A) of said bolt unit (103) to a first position by said first joint for loading of a bolt, wherein said first position for loading of a bolt is a position where said first end of said bolt unit is at a shorter distance from said carrier compared to the distance from said first joint to said carrier, and wherein said first position is a position where said bolt can be provided to said bolt unit from under secured rock, said means for holding said rock bolt (123, 125) arranged at said bolt unit (103) for, when said bolt unit (103) has been maneuvered to said first position for loading of a bolt, receiving a rock bolt (124), and when said bolt unit (103) has been loaded with said rock bolt (124), means for maneuvering said bolt unit (103) by said first joint to a position for installation of said rock bolt (124) and, loaded with said rock bolt (124), means for drilling said first hole and installing said rock bolt (124) in said first hole;

wherein drilling is arranged to be performed along a first drilling axis, wherein said bolt unit (103) comprises a first axis (A) being parallel with the drilling axis, wherein said feeder unit (104) is rotatable about said first axis (A) between a first position and a second position, wherein in said first position the feeder unit is in a drilling position with the drilling machine coaxial with the drilling axis, and wherein in said second position the center of the bolt of said rock bolt is coaxial with said drilling axis.

21. Rock bolting rig according to claim 20, further including at least one support element (127) for fixating said bolt unit (103) prior to drilling and bolt installation, wherein said axis (A) is essentially coaxial with an axis of said at least one support element.

22. Rock bolting rig according to claim 20, wherein said means for holding includes a first displaceable holder (123), and wherein said first displaceable holder (123) is arranged at said bolt unit such that that rotation of the feeder about said first axis (A) moves said rock bolt along a circular arc having the center thereof in said first axis (A) and passing said drilling axis.

23. Rock bolting rig according to claim 22, wherein rotation of the feeder unit between said first and second positions, respectively, is achieved by a feeder arm (128) rotatable about said axis (A).

24. Rock bolting rig according to claim 20, wherein said bolt unit further comprises a drill rod arm (132) rotatable about said first axis (A), wherein said drill rod arm (132) is arranged to carry at least a first drill rod (130), and wherein, during rotation of said drill rod arm, said first drill rod is moved along a circular arc passing through said drilling axis.

25. Rock bolting rig according to claim 24, wherein said drill rod arm (132) is arranged to carry at least said first drill rod (130) and a second (131) drill rod, respectively, wherein when rotating said drill rod arm (132) said first (130) and second (131) drill rods, respectively are moved along a circular arc having the center in said axis (A) and passing through the center of the drilling.

26. Rock bolting rig for installation of a rock bolt (124) in a first drill hole, wherein said rock bolting rig (100) comprises a carrier (101), a boom unit (102) fastened to said carrier (101), and a bolt unit (103) fastened to said boom unit (102) via a first joint (106), wherein said bolt unit (103) comprises a feeder unit (104) including means for displaceable carrying of a drilling machine (105), wherein said bolt unit comprises a first (103A) end and means (123, 125) for holding said rock bolt (124), wherein the rock bolting rig comprises:

means for maneuvering said first end (103A) of said bolt unit (103) to a first position by said first joint for loading of a bolt, wherein said first position for loading of a bolt is a position where said first end of said bolt unit is at a shorter distance from said carrier compared to the distance from said first joint to said carrier, and wherein said first position is a position where said bolt can be provided to said bolt unit from under secured rock, said means for holding said rock bolt (123, 125) arranged at said bolt unit (103) for, when said bolt unit (103) has been maneuvered to said first position for loading of a bolt, receiving a rock bolt (124), and when said bolt unit (103) has been loaded with said rock bolt (124), means for maneuvering said bolt unit (103) by said first joint to a position for installation of said rock bolt (124) and, loaded with said rock bolt (124), means for drilling said first hole and installing said rock bolt (124) in said first hole;

further including an arm (501) swingable towards the drilling axis, wherein said arm carries a bolt adapter (505), and wherein said center of said bolt adapter (505) is swingable towards said drilling axis by said arm (501).

27. Rock bolting rig according to claim 26, wherein said arm (501) comprises a bayonet mount (506) for carrying said bolt adapter (505).

28. Rock bolting rig according to claim 26, wherein said arm is an injection arm (501), wherein said injection arm (501) comprises an injection nozzle (502) that can be brought towards the drilling axis for supply of resin to a drilled hole.

29. Rock bolting rig according to claim 28, wherein, when said injection arm (501) comprises a bolt adapter (505), said bolt adapter is carried coaxially with said nozzle (502) so that when the injection arm (501) is brought to a position for injection, the bolt adapter will also be positioned coaxially with the drilling axis.

30. Rock bolting rig according to claim 28, wherein said arm (501) is pivotally fastened to said swing arm (504) in such a manner that when the arm (501) is swung towards the drilling axis, the injection nozzle (502) is aligned essentially coaxially with the drilling axis.

31. Rock bolting rig according to claim 26, wherein said arm (501) is arranged to be swung about a swing axis (SI) via a swing arm (504), wherein said swing axis (Si) is essentially at right angles with the drilling axis.

32. Rock bolting rig according to claim 26, wherein said arm (501), when swung towards the drilling axis, is moved axially in the drilling direction by swinging motion.

* * * * *